United States Patent [19]

Habicht et al.

[11] Patent Number: 4,879,957

[45] Date of Patent: Nov. 14, 1989

[54] IMPACT-IMPEDING PANE/FRAME STRUCTURE

[75] Inventors: Siegfried Habicht, Leopoldshöhe; Rainer Reppert; Eitel-Friedrich Höcker, both of Bielefeld, all of Fed. Rep. of Germany

[73] Assignee: Schuco International GmbH & Co., Fed. Rep. of Germany

[21] Appl. No.: 63,637

[22] Filed: Jun. 17, 1987

[30] Foreign Application Priority Data

Jul. 23, 1986 [DE] Fed. Rep. of Germany ..... 3624849

[51] Int. Cl.[4] ..... E06B 05/10

[52] U.S. Cl. ..... 109/79; 109/49.5; 52/475

[58] Field of Search ..... 52/393, 482, 579, 732, 52/739; 109/26, 49.5, 74, 77; 89/36.02, 36.04

[56] References Cited

U.S. PATENT DOCUMENTS

| | | | |
|---|---|---|---|
| 406,122 | 7/1889 | Brown | 109/77 X |
| 735,588 | 8/1903 | Reynolds et al. | 109/74 |
| 1,464,213 | 8/1923 | Mosler et al. | 109/74 |
| 3,636,895 | 1/1972 | Kelsey | 109/78 |
| 4,598,647 | 7/1986 | Biedess | 109/77 |
| 4,625,659 | 12/1986 | Saelzer | 109/49.5 |
| 4,630,411 | 12/1986 | Sälzer | 52/1 |

FOREIGN PATENT DOCUMENTS

| | | | |
|---|---|---|---|
| 2855360 | 7/1980 | Fed. Rep. of Germany | 52/732 |
| 2818745 | 10/1984 | Fed. Rep. of Germany . | |

*Primary Examiner*—Carl D. Friedman
*Assistant Examiner*—Lan Mai
*Attorney, Agent, or Firm*—Laubscher, Presta & Laubscher

[57] ABSTRACT

An impact-impeding structure includes a pane which extends along a plane and has a front and a rear side, and an impact-impeding frame for the pane. The frame may include an outer frame member and an inner frame member received in the outer frame member, the frame members being provided at least at one of the front and rear sides of the pane with impact-impeding elements, and defining with one another a labyrinthine gap situated at a region of the impact-impeding elements and including a plurality of steps extending at least substantially parallel to the plane. The parts of the gap which interconnect the steps extend at an angle deviating from the normal to the plane of the pane and may have different widths which may decrease from the exterior to the interior of the frame arrangement. In the alternative or in addition, at least one frame of the frame arrangement may be provided with a plurality of internal chambers which are delimited by lateral limiting surfaces that extend at an acute angle with respect to the plane of the pane and which may accommodate respective inserts, or such frame may include a plurality of parts that contact each other at contact surfaces which extend at least in part at an acute angle with respect to the plane of the pane, such as by extending along sawtooth-shaped courses.

2 Claims, 5 Drawing Sheets

IMPACT-IMPEDING PANE/FRAME STRUCTURE

BACKGROUND OF THE INVENTION

The present invention relates to pane/frame structures in general, and more particularly to a pane/frame structure which has impact-impeding properties.

There are already known various constructions of the impact-impeding structures of the type here under consideration, among them such which include a pane extending along a plane and having a front and a rear side, and an impact-impeding frame for the pane, wherein the frame includes an outer frame member and And inner frame member received in the outer frame member. The frame members are provided at least at one of the front and rear sides of the pane with impact-impeding elements of an aluminum alloy and define with one another a labyrinthine gap situated at a region of the impact-impeding elements and including a single stage extending at least substantially parallel to the plane of the pane.

So, for instance, the German Patent DE-PS No. 28 18 745 discloses a window or door structure of the above type in which the casement frame member and the window or door opening frame member are made of profiled sections of aluminum, and wherein respective impact-impeding plates made of an aluminum alloy are glued or welded to the outer side or the inner side of the profiled aluminum sections of the casement frame and of the opening frame. The impact-impeding plates are so configured at the region of the gap between the casement frame and the opening frame that a fold comes into existence in the width of the gap, this fold having a step at the area of the center of the impact-impeding plates, this step extending parallel to the plane of the window or door pane.

It is further known to make the frames of a window, of a door and of a stationary glass pane of heat-insulated composite profiled elements, in which a profiled aluminum section is constructed as an impact-impeding structural element, has a larger wall thickness than the other metallic profiled element and consists of a special metallic alloy. Insulating rods which are situated between the two profiled metallic rails or sections are connected with the metallic rails by pressing respective metallic webs of the metallic profiled rails against respective longitudinally extending marginal bulges of the insulating rods. At the region of the gap between the opening frame and the casement frame, the impact-impeding metallic profiled rails form an abutment in the form of a step which extends parallel to the plane of the window or door pane.

In the heretofore known constructions, when the one-step labyrinthine gap between the opening frame and the casement frame receives a direct hit or impact by a projectile, only 50% at the most of the effective thickness of the impact-impeding structural elements is available at this region for impeding the impact.

SUMMARY OF THE INVENTION

Accordingly, it is a general object of the present invention to avoid the disadvantages of the prior art.

More particularly, it is an object of the present invention to provide an impact-impeding pane/frame structure which does not possess the drawbacks of the known structures of this type.

Still another object of the present invention is to devise a structure of the type here under consideration which has an improved impact resistance without having an increased thickness.

It is yet another object of the present invention to design the above structure in such a manner as to be able to deflect a projectile which reaches and impacts a frame member thereof.

A concomitant object of the present invention is to so construct the structure of the above type as to be relatively simple in construction, inexpensive to manufacture, easy to use, and yet reliable in operation.

In keeping with these objects and others which will become apparent hereafter, one feature of the present invention resides in an impact-impeding structure which comprises a pane extending along a plane and having a front and a rear side, and impact-impeding frame means for the pane. The frame means advantageously includes an outer frame member and an inner frame member received in the outer frame member. These frame members are provided at least at one of the front and rear sides of the pane with impact-impeding elements of an aluminum alloy, and define with one another a labyrinthine gap situated at a region of the impact-impeding elements. The labyrinthine gap includes a plurality of steps extending at least substantially parallel to the plane of the pane.

In accordance with an advantageous aspect of the present invention, the labyrinthine gap has a width as considered parallel to the plane of the pane which is different between each of the steps. It is particularly advantageous when such width decreases from the exterior to the interior of the frame means. Furthermore, those parts of the labyrinthine gap that extend between the steps advantageously extend at an angle differing from a perpendicular to the plane of the pane.

As a result of the arrangement of a plurality of steps at the region of the labyrinthine gap, the incoming projectile which penetrates to the first step encounters a greater material thickness of the impact-impeding structural part than in the known constructions. A perpendicularly arriving projectile must penetrate at the region of the labyrinthine gap through a plurality of external contours at least some of which extend at an angle with respect to the trajectory of such projectile, and in each such encounter the projectile is deflected. The projected surface of the projectile with respect to its direction of movement is increased with each such deflection and this, in turn, results in a situation where a greater amount of the kinetic energy of the projectile can be destroyed or absorbed in the impact-impeding structural element due to such increase in the projected surface.

Outside the region of the labyrinthine gap between the opening frame and the casement frame, the impact resistance can be made more pronounced by so constructing the frame as to include a plurality of impact-impeding components each of which is provided with a plurality of internal chambers delimited by lateral limiting surfaces that extend at an acute angle with respect to the plane of the pane, or by making the frame from a plurality of impact-impeding components each of which consists of a plurality of parts that have respective contact surfaces that extend at least in part at an acute angle with respect to the plane of the pane. These measures for the improvement of the impact-impeding effect can also be employed in connection with stationary glass panes.

According to an additional facet of the invention, there may be further provided a plurality of impact-impeding structural elements accommodated in the aforementioned internal chambers. These structural elements are advantageously made of a material selected from the group consisting of aluminum alloy, steel, ceramic material and glass. It is particularly advantageous when these structural elements are constructed as inserts consisting of layered sheet-metal components. The sheet-metal components have respective contact surfaces which contact each other in each of the inserts and advantageously extend either at right angles to, or in parallel with, the lateral limiting surfaces of the internal chambers.

When the multipartite impact-impeding elements are employed, it is advantageous when at least one sheet-shaped element is interposed between the contact surfaces of the parts and when this sheet-shaped element is of a different material than the parts of the impact-impeding elements. The contact surfaces advantageously extend along sawtooth-shaped courses. It is also advantageous when these contact surfaces delimit respective gaps with one another.

Even the above-mentioned measures result in a situation where the projectile impacting the frame outside the region of the gap is forced to change its axially directed propagation direction within the impact-impeding structural components or elements. Even a change of the axially oriented position in small steps brings about a substantial improvement in the impact-impeding effect.

BRIEF DESCRIPTION OF THE DRAWING

The present invention will be described below in more detail with reference to the accompanying drawing in which.

DETAILED DESCRIPTION OF THE PREFERRED EMBODIMENT

Figure 1:
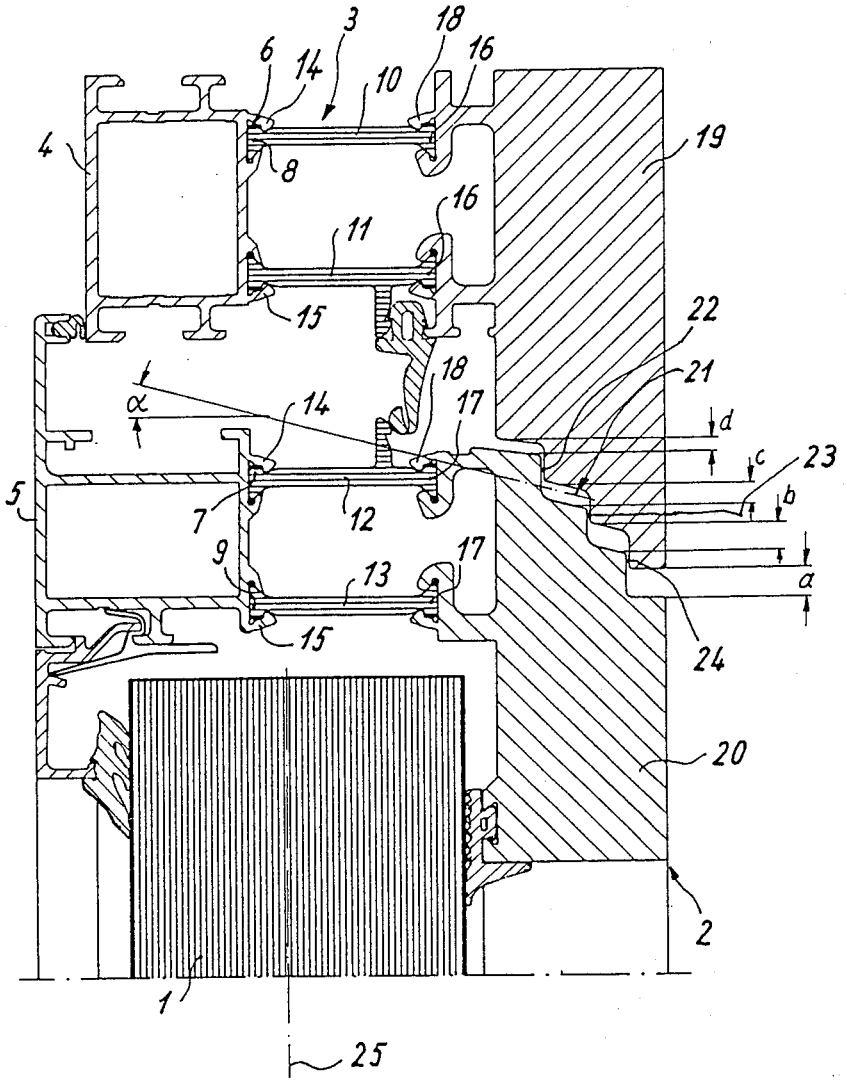
FIG. 1 is a sectioned view of a part of an impact-impeding window constructed in accordance with the present invention.

Referring now to the drawing in detail, and first to FIG. 1 thereof, it may be seen that the reference numeral 1 has been used therein to identify a pane of an impact-impeding structure of the present invention which will be described below as embodied in a casement window. However, it is to be understood that the present invention is equally applicable for use in other types of windows, such as sash windows, in doors, or even in conjunction with stationarily mounted window panes. In the construction depicted in FIG. 1, as well as in the modified constructions which will be described later in conjunction with FIGS. 2 to 5, the pane 1 has front and rear sides and has impact-impeding properties. In the construction of FIG. 1, the pane 1 is surrounded at its marginal portion by a casement frame 2 which consists of heat-insulated composite profiled sections.

The inner casement frame 2 is received in an outer window opening frame 3 which is also constituted by heat-insulated composite profiled sections. The casement frame 2 and the window opening frame 3 are provided at the inner side of the window with respective customary aluminum profiled sections 4 and 5 that are provided with receiving grooves 6 and 7 for marginal bulges 8 and 9 of insulation rods 10, 11, 12 and 13. Respective outwardly situated metallic webs 14 and 15 are pressed against the marginal bulges 8 and 9 of the insulation rods 10, 11, 12 and 13 for connecting the insulation rods 10, 11, 12 and 13 to the aluminum profiled sections 4 and 5.

The insulation rods 10, 11, 12 and 13 further include additional marginal bulges 16 and 17 which are connected to respective metallic profiled impact-impeding sections 19 and 20 in the same manner as described above by being received in respective grooves and by having respective metallic webs 18 deformed against them.

The metallic profiled sections 19 and 20 of the window opening frame 3 and of the casement frame 2, which are constructed in an impact-impeding manner, delimit a labyrinthine gap 21 which includes three steps 22, 23 and 24 that extend parallel to a main plane 25 of the panel for a window, door or a similar structure.

The width of the labyrinthine gap 21 between the individual steps 22, 23 and 24 is different. In the exemplary embodiment of the invention that is depicted in FIG. 1 of the drawing, the width of the gap 21 between the individual steps 22, 23 and 24 decreases from the outside to the inside of the structure. The individual gap widths a, b, c and d, which decrease from a to d, are indicated in FIG. 1 of the drawing.

It may also be seen in FIG. 1 of the drawing that the parts of the labyrinthine gap which are situated between the individual steps 22, 23, and 24, can be inclined at an angle $\alpha$ with respect to a normal to the plane of the window opening frame 3. Thus, a projectile that may enter the gap 21 in a direction substantially normal to the main plane 25 of the structure is deflected from its original trajectory upon contact with the respective lateral wall that delimits the respective sep 22, 23 or 24.

Figure 2:
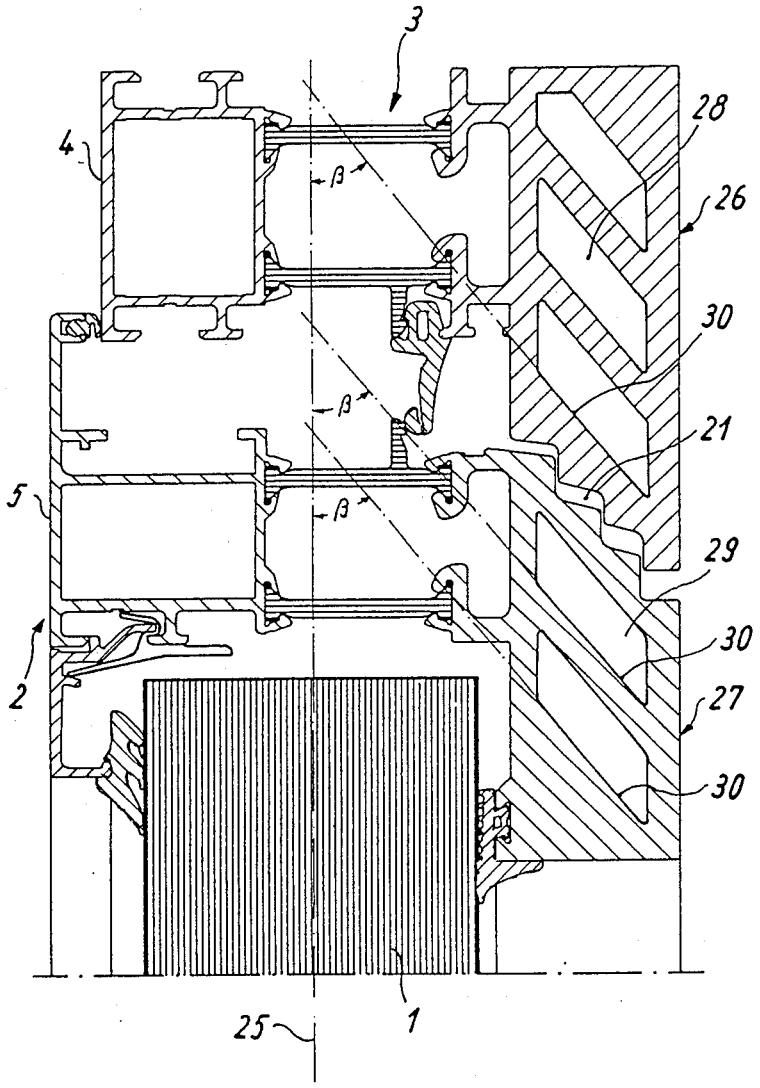
FIG. 2 is a view similar to FIG. 1 but of a modified construction.

The exemplary embodiment of the invention that is illustrated in FIG. 2 of the drawing differs from that depicted in FIG. 1 basically in that respective impact-impeding profiled sections 26 and 27 of the window opening frame 3 and of the casement frame 2 are provided with internal chambers 28 and 29. These internal chambers 28 and 29 are delimited by respective lateral surfaces 30 that extend at an acute angle $\beta$ with respect to the main plane 25 of the window, door or similar structure. In the exemplary embodiment illustrated in Fig. 2 of the drawing, the internal chambers 28 and 29 have relatively large dimensions. However, the internal chambers 28 and 20 could also have slot-shaped configurations and there could be provided a larger number of them.

Even in this exemplary embodiment, a projectile penetrating into such an internal chamber 28 or 29 is deflected upon contacting the respective inclined lateral surface 30 delimiting the respective internal chamber 28 or 29 from its original direction of movement. This has the advantage that the impact-impeding effect of the metallic profiled sections 26 and 27 is enhanced.

Figure 3:
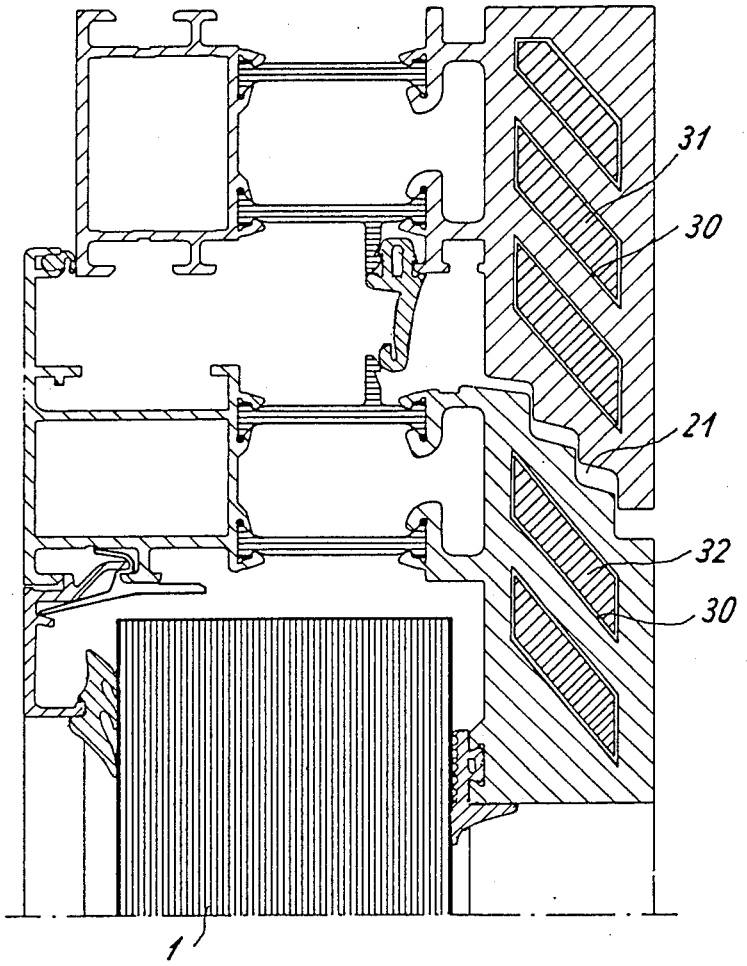
FIG. 3 is a view similar to FIGS. 1 and 2 but of a further modification.

In the exemplary embodiment of the present invention which is illustrated in FIG. 3 of the drawing, the internal chambers 28 and 29 are filled by respective inserts 31 and 32. These inserts 31 and 32 are composed of individual sheet metal layers which thus form a plurality of separating surfaces which are capable of contributing to the deflection of a projectile.

Figure 4:
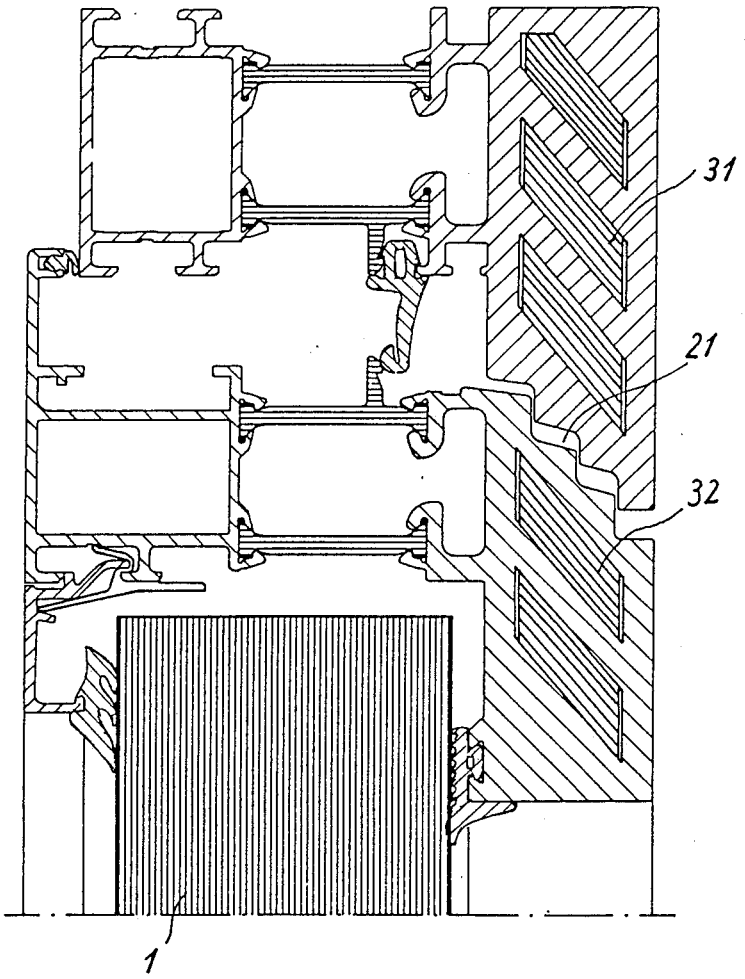
FIG. 4 is a view similar to FIGS. 1 to 3 but of a still further modification.

The separating surfaces of the sheet metal layers that together form the inserts 31 and 32 can extend either perpendicularly to or in parallel with the delimiting surfaces 30 of the internal chambers 28 and 29. The first possibility is illustrated in FIG. 3, while the second possibility is shown in FIG. 4 of the drawing.

Instead of the inserts 31 and 32 that consists of sheet metal layers or lamellae, the internal chambers 28 and 29 can also be filled with structural parts which consist of steel, ceramic material, glass, or of a special aluminum alloy.

Figure 5:
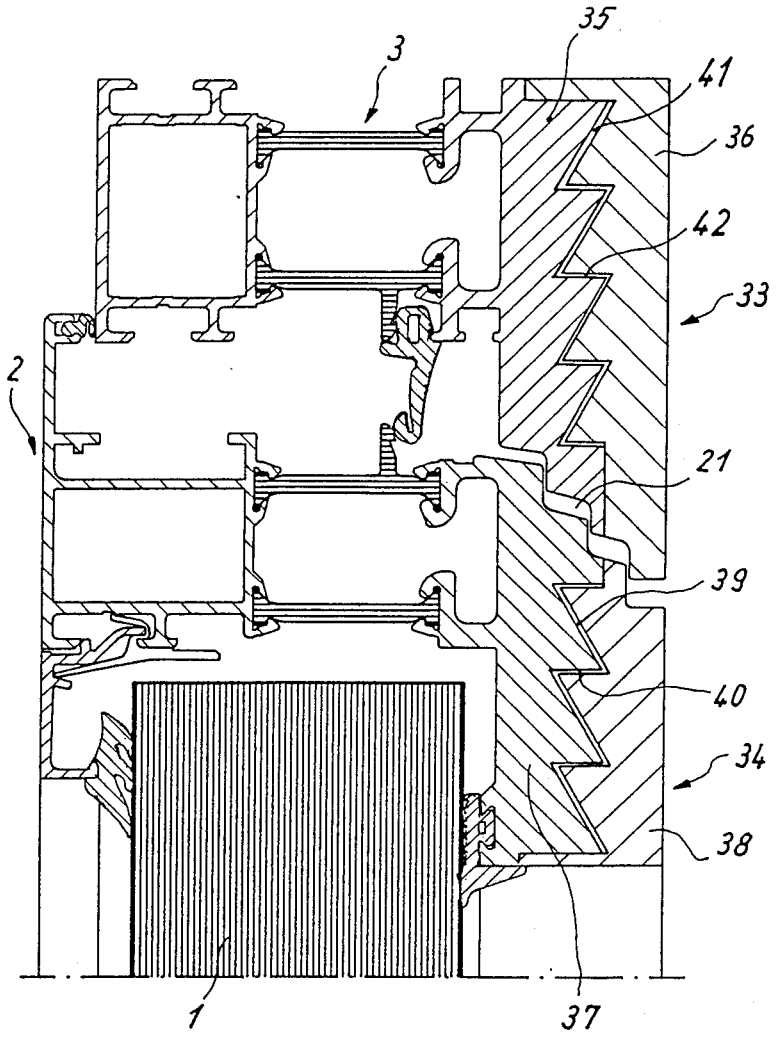
FIG. 5 is a view similar to FIGS. 1 to 4 but of yet another modification.

FIG. 5 of the drawing shows an impact-impeding window in which respective impact-impeding profiled sections 33 and 34 of the window opening frame 3 and of the casement frame 2, which are arranged at the outside of the window structure, consist of a plurality of parts. In the illustrated construction, each of the profiled sections 33 and 34 consists of two individual parts 35 and 36, or 37 and 38. The connecting surfaces of the respective individual parts 35 and 36, or 37 and 38, which together constitute the respective profiled section 33 or 34, extend along sawtooth-shaped courses. The respective individual parts 35 and 36, or 37 and 38 are connected with one another by means of screws, by gluing or by welding.

It may be seen in the illustration according to FIG. 5 that the sawtooth-shaped surfaces of the individual parts 35 and 36, or 37 and 38, delimit with one another respective gaps 41 and 42, or 39 and 40.

Sheet-metal elements or lamellae may also be inserted into these gaps 41 and 42, or 39 and 40. Such sheet-metal elements or lamellae may consist of a material that is different from that of the aforementioned profiled sections 33 and 34

Extruded or rolled profiled sections have a different density and quality at their outer surfaces than in their interiors. This different quality and density results in an increased hardness and toughness of the material at such outer surfaces.

When these outer surfaces are arranged in the interior of the respective impact-impeding structure or component and when they extend at an acute angle with respect to the normal to the main plane of such structure or component, then a projectile which abuts such an outer surface region is initially more pronouncedly decelerated and is further deflected from its initial direction of movement, so that the impact-impeding effect is improved in two respects.

By resorting to the use of the aforementioned measures, there is obtained a higher class of impact-impeding action, without any increase in the thickness of the impact-impeding components.

The measures which have been discussed above in conjunction with their utilization in illustrated exemplary embodiments relating to casement windows can also be used in doors and immovable glass pane structures. The impact-impeding structural parts can also be constituted by unitary or multi-part plates which are connected and/or encapsulated with profiled rails of aluminum, of other metals, of wood, of synthetic plastic materials, or of a combination of these materials.

While the present invention has been described and illustrated herein as embodied in specific constructions of impact-impeding structures, it is not limited to the details of such particular constructions, since various modifications and structural changes are possible and contemplated by the present invention. Thus, the scope of the present invention will be determined exclusively by the appended claims.

What is claimed is:

1. An impact-impeding structure, comprising (a) a pane arranged in a plane and having front and rear sides;

(b) impact-impeding frame means for supporting said pane, said frame means including (1) an outer frame including a first longitudinal impact-impeding section arranged on at least one side of said pane; and (2) an inner frame arranged within said outer frame and including a second longitudinal impact-impeding section arranged on said one side of said pane coplanar with said first impact-impeding section, said first and second impact-impeding sections each having a continuous stepped profile comprising a plurality of steps, each step including lateral and longitudinal portions, said profiles being arranged opposite each other and having corresponding configurations to define a labyrinthine gap therebetween, said gap having a longitudinal width defined between corresponding lateral step portions of said sections which decreases in the direction toward said plane, whereby when a projectile penetrates said gap, the projectile is deflected through the gap to deplete the kinetic energy of the projectile and minimize the risk of the projectile damaging said pane.

2. Apparatus as defined in claim 1, wherein at least one of the steps of said profile of said impact-impeding sections is arranged at an angle ($\alpha$) relative to a plane perpendicular to the plane containing said pane.

* * * * *